US006033777A

United States Patent [19]

Best

[11] Patent Number: 6,033,777

[45] Date of Patent: Mar. 7, 2000

[54] MELT-EXTRUDED MONOFILAMENT

[75] Inventor: Walter Best, Duren, Germany

[73] Assignee: Thomas Josef Heimbach GmbH, Germany

[21] Appl. No.: 08/974,316

[22] Filed: Nov. 19, 1997

[30] Foreign Application Priority Data

Nov. 20, 1996 [DE] Germany ..... 196 48 092
Nov. 26, 1996 [DE] Germany ..... 196 48 884

[51] Int. Cl.[7] ..... D02G 3/00; C08L 61/02

[52] U.S. Cl. ..... 428/364; 428/395; 525/440

[58] Field of Search ..... 428/395, 364, 428/373; 525/440; 139/383 A

[56] References Cited

U.S. PATENT DOCUMENTS

| | | | |
|---|---|---|---|
| 4,436,877 | 3/1984 | Kasuga et al. | 525/437 |
| 5,137,601 | 8/1992 | Hsu | 162/358.2 |
| 5,169,711 | 12/1992 | Bhatt et al. | 139/383 A |
| 5,319,039 | 6/1994 | Moses et al. | 525/440 |
| 5,502,120 | 3/1996 | Bhatt et al. | 525/440 |
| 5,700,881 | 12/1997 | Wagner et al. | 525/440 |
| 5,763,040 | 6/1998 | Murphy et al. | 428/96 |

FOREIGN PATENT DOCUMENTS

| | | |
|---|---|---|
| 2175875 | 11/1996 | Canada . |
| 0387395 | 12/1994 | European Pat. Off. . |
| 4410399 | 9/1995 | Germany . |
| 081973 | 1/1977 | Japan . |
| 081427 | 1/1997 | Japan . |
| 9600808 | 1/1996 | WIPO . |

*Primary Examiner*—Newton Edwards
*Attorney, Agent, or Firm*—Liniak, Berenato, Longacre & White

[57] ABSTRACT

The invention is directed to a melt-extruded monofilament having 95 weight % of a mixture of polytrimethyleneterephthalate and polyuirethane, the poly,urethane is no more than 45 weight % of the mixture.

7 Claims, No Drawings

MELT-EXTRUDED MONOFILAMENT

The invention concerns a melt-extruded monofilament for use in engineering textiles, in particular in paper machine cloths, that consists substantially of a plastic material.

Melt-extruded monofilaments of this kind have high strength, and are therefore preferred for use in load-bearing structures such as woven and knitted engineering textiles, and in particular in cloths for paper machines.

At present, monofilaments based on polyethylene terephthalate (PET) are primarily used; in particular cases, to increase abrasion resistance, they contain a proportion of thermoplastic polyurethane (PU), as is known for example from EP 0 387 395 B1. These PET-based monofilaments have certainly proven successful in practical use, but their manufacture is often problematic. The reason is that the extrusion of monofilaments made of polyethylene terephthalate and polyurethane, and subsequent setting thereof in the textile, take place at high temperatures, which is often undesirable for various reasons. In particular, the high temperatures used can also have a damaging effect on the polyurethane. This damage can be counteracted only by complex measures, and also only partially.

It is therefore the object of the invention to create a monofilament for textile materials of the type cited initially, that can be extruded and later set easily and at lower temperatures.

This object is achieved, according to the invention, by the fact that the plastic material has as its principal component polytrimethylene terephthalate (PTMT). Because, according to the invention, polytrimethylene terephthalate (PTMT) is used instead of the previously used polyethylene terephthalate materials, it is possible, in the desired fashion, for extruding and setting of the monofilaments to take place at lower temperatures. This also makes it possible, in particular, to lower manufacturing and handling costs considerably. It has moreover been found that the properties of PTMT-based monofilaments tends more in the direction of the properties of polyamide as compared with PET-based monofilaments, which in certain cases may also be desirable.

Theoretically, the plastic material can consist exclusively of polytrimethylene terephthalate. According to a preferred embodiment, however, in order to increase abrasion resistance the plastic material contains, in particular, elastomeric polyurethane (PU), specifically up to a proportion of 45 wt %. In this instance the utilization according to the invention of PTMT materials has the further advantage that the temperatures occurring during manufacture and treatment are so low that they do not damage the polyurethane, and the protective measures provided in the existing art can thus be omitted, which also contributes to a reduction in costs.

In a development of the invention, provision is made for the plastic material to contain, in a manner known per se, a hydrolysis stabilizer, specifically and preferably up to a proportion of 5 wt %.

The melt-extruded monofilaments according to the invention can have any desired cross-sectional shape, i.e. they can be, for example, rectangular, clover-leaf-shaped, dog-bone-shaped, star-shaped, round, oval, or the like, and can, in particular, also have a hollow cross section. The cross-sectional area of the monofilaments is preferably between 0.02 $mm^2$ and 3.5 $mm^2$, which in the case of a round cross section corresponds to a diameter of from 0.08 to 1 mm.

The PTMT material can, for example, be manufactured by the condensation of terephthalic acid and 1,3-propanediol.

PTMT materials are already known per se, and have also already been used for the production of fibers. The specific strength achieved in that context was, however, too low for the application in load-bearing structures such as woven and knitted engineering textiles. It is that much more surprising that the monofilaments according to the invention based on PTMT have sufficient strength for use in such engineering textiles, and in particular paper machine cloths.

In addition, it has been possible with the melt-extruded monofilaments according to the invention to achieve much higher stretching ratios than is indicated in the literature for PTMT-based fibers. In experiments, stretching ratios of up to 1.0:4.5 were achieved with the monofilaments according to the invention; by comparison, the stretching ratios achievable for PTMT as indicated in the literature are only 1.0:2.4.

What I claim is:

1. Melt-extruded monofilament consisting essentially of 95 weight percent of a mixture of polytrimethyleneterephthalate and polyurethane, the polyurethane comprising no more than 45 weight percent of the mixture.

2. The melt-extruded monofilament as defined in claim 1, wherein the cross-sectional area of the monofilament is from 0.02 $mm^2$ to 3.5 $mm^2$.

3. The melt-extruded monofilament as defined in claim 2, wherein the monofilament has a round cross section with a diameter between 0.08 and 1 mm.

4. The melt-extruded monofilament as defined in claim 1, characterized by having a square, rectangular, oval, clover-leaf-shaped, or dog-bone-shaped cross section.

5. A paper machine cloth, characterized by containing melt-extruded monofilaments as defined in claim 1.

6. The monofilament of claim 1, wherein the balance of the mixture is hydrolysis stabilizer.

7. Melt-extruded monofilament consisting of 95 weight percent of a mixture of polytrimethyleneterephthalate and polyurethane, the polyurethane comprising no more than 45 weight percent of the mixture, wherein the balance of the mixture is an hydrolysis stabilizer.

* * * * *